United States Patent [19]

Friedman

[11] 4,368,767

[45] Jan. 18, 1983

[54] READILY ASSEMBLABLE POCKETBOOK

[76] Inventor: Leonard Friedman, 190 Kelly Blvd., Staten Island, N.Y. 10314

[21] Appl. No.: 223,859

[22] Filed: Jan. 9, 1981

[51] Int. Cl.[3] ..... A45C 13/04

[52] U.S. Cl. ..... 150/29

[58] Field of Search ..... 150/31, 32, 29

[56] References Cited

U.S. PATENT DOCUMENTS

| | | | |
|---|---|---|---|
| 1,952,131 | 3/1934 | Hiering | 150/29 |
| 2,572,683 | 10/1951 | Wachs | 150/29 |
| 3,234,985 | 2/1966 | Gilbert | 150/29 |

FOREIGN PATENT DOCUMENTS

| | | | |
|---|---|---|---|
| 855292 | 5/1940 | France | 150/29 |
| 1075358 | 10/1954 | France | 150/29 |

*Primary Examiner*—George T. Hall
*Assistant Examiner*—Gary E. Elkins
*Attorney, Agent, or Firm*—Friedman, Goodman & Teitelbaum

[57] ABSTRACT

A pocketbook permitting a pouch to be readily assembled to a hinged frame construction, the frame construction including a support bar with a clamp pivotally connected thereto which can swing from an open position to a closed position. In the open position, entry of upper extensions of the side walls of the pouch can be positioned in an entry channel formed between the clamp and the support bar, and then the clamp can be closed onto the extensions to hold the pouch in a supported position relative to the frame construction. The frame construction permits the pouch to be interchangeable with other pouches, wherein the same frame construction is used with the other pouches.

4 Claims, 9 Drawing Figures

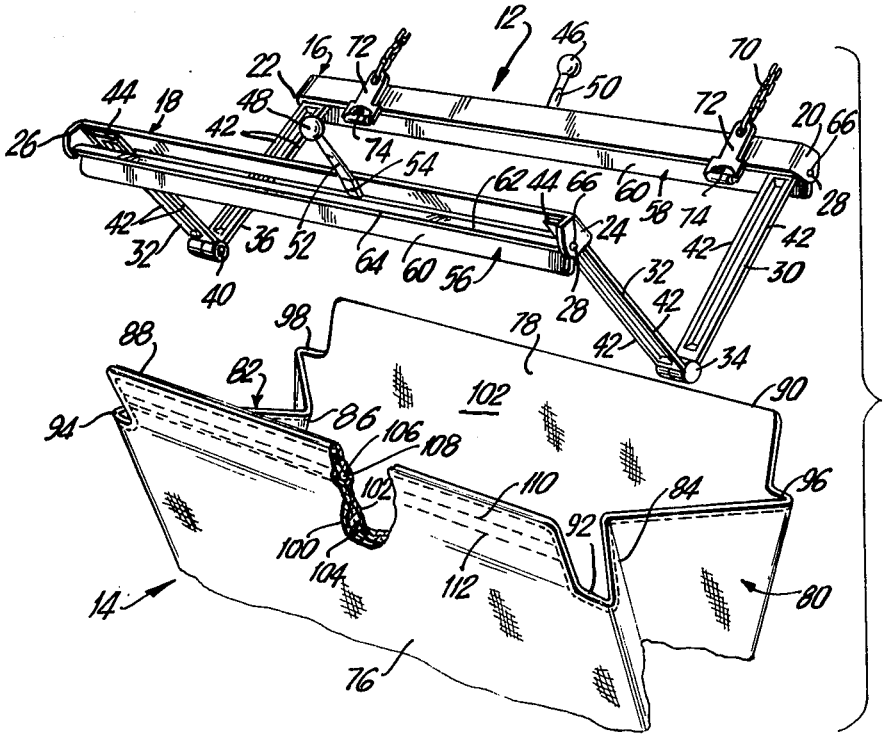
FIG.3
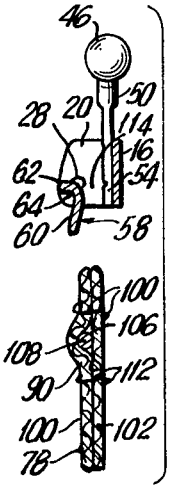
FIG.5
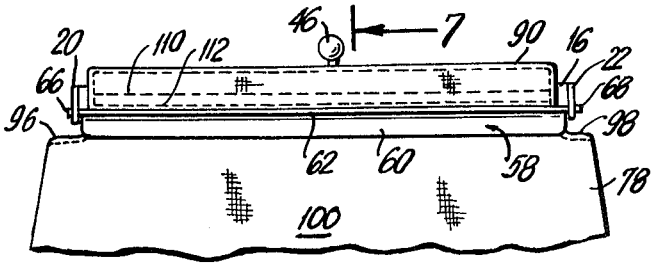
FIG.4
FIG.6
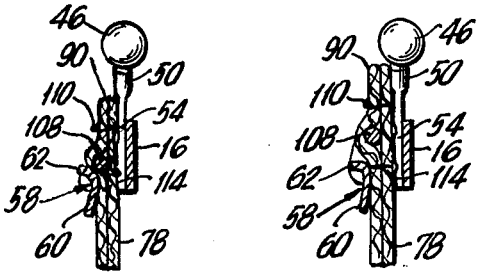
FIG.7
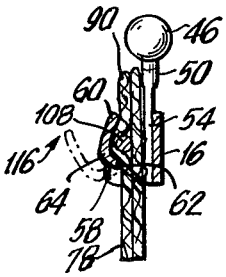
FIG.8
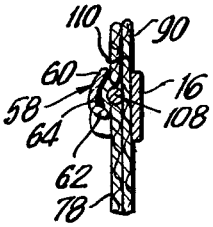
FIG.9

READILY ASSEMBLABLE POCKETBOOK

BACKGROUND OF THE INVENTION

This invention relates to pocketbooks, and more particularly to pocketbooks having a pouch portion which is readily assemblable to the pocketbook frame. Furthermore, the construction of the present invention permits the pouch portion to be interchangeable with other pouch portions.

Pocketbooks are utilized both for function and for style. The pocketbook itself is used as a container for various materials, and includes a pouch portion supported on a frame construction. In prior art pocketbooks, the pouch portion is permanently secured to the frame construction, where in most cases, the frame construction is clamped onto the pouch portion, thereby requiring additional equipment for permanently securing the frame construction and pouch portion together. In the use of such prior art equipment, a great deal of time is required in the positioning of the pouch portion relative to the frame construction prior to the clamping thereof, wherein these pocketbook portions must be properly positioned in order to obtain the permanent securement therebetween. It would therefore be useful to provide a frame construction and pouch portion which could easily be secured together without requiring the above mentioned prior art equipment for permanent clamping same together.

Furthermore, a woman usually has an assortment of pocketbooks which match various pieces of clothing of her wardrobe. The part of the pocketbook that is generally selected to match the particular piece of clothing is the pouch portion. The frame construction of the pocketbook, however, is usually constructed according to a selected style, and rarely is it selected for a particular color or material. As a result, it would be convenient to have a universal type pocketbook frame construction while at the same time facilitating assemblability and interchangeability of the pouch portion which is supported on the frame construction. In this manner, the time of assembly is reduced and the cost of the mechanical part of the pocketbook, including the frame construction, is expended only once. At the same time, by facilitating interchangeability of the pouch portion, the pocketbook can effectively be redesigned so that different colors, fabrics, etc. can be utilized in conjunction with the single frame construction.

This above readily assemblable and interchangeable arrangement would reduce the cost of manufacturing and maintaining a collection of assorted pocketbooks, and would eliminate the clamping equipment and cost thereof. At the same time, it would permit the user to coordinate the pocketbook as desired in accordance with the particular wardrobe selected.

SUMMARY OF THE INVENTION

Accordingly, it is an object of the present invention to provide a pocketbook of the aforedescribed readily assemblable type.

Another object of the present invention is to provide a pocketbook having an upper frame construction on which is supported a readily assemblable pouch portion.

A further object of the present invention is to permit the use of a pocketbook which has an interchangeable pouch portion, so that a particular color, fabric, design, etc. can be selected and utilized with a single upper frame construction.

Yet a further object of the present invention is to provide a pocketbook having an upper frame construction with a clamping mechanism so as to facilitate assembly, replacement and interchangeability of the pouch portion which is supported on the upper frame construction.

Another object of the present invention is to provide a pocketbook having a readily assemblable pouch portion supported therefrom, and including clamping means which can securely retain a selected pouch portion in place on the upper frame construction, and which eliminates the requirement of the prior art clamping equipment and cost thereof.

Briefly, in accordance with the present invention, there is described a pocketbook having a hinged upper frame construction with a pouch supported therefrom, wherein the pouch can readily be assembled to the frame construction. A clamping mechanism is formed with the upper frame construction and cooperates with a portion of the pouch for releasably retaining the pouch from the upper frame construction.

The upper frame construction includes a pair of support bars which are interconnected at their respective ends by folding arms. A clamping bar is pivotally coupled with respect to each of the support bars. Each of the clamping bars is rotatable between an open position and a closed position. In the open position, an entry channel is provided between the support bar and its respective clamping bar for receiving therein a portion of the pouch. In the closed position, the inserted pouch portion is retained clamped between the support bar and its respective clamping bar. The portion of the pouch inserted into the channel is an upper extension of the side walls of the pouch. A compressible cord is provided within each upper extension. The cord is squeezed and retained in its position when the clamping bar is placed in the closed position to secure the pouch within the clamping mechanism.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which:

FIG. 3 is a fragmented exploded perspective view of the upper hinged frame construction and the pouch portion;

FIG. 4 is a fragmented elevational view showing the pouch portion inserted into the clamping mechanism prior to closure of the clamping mechanism;

FIGS. 5 and 6 show the pouch being inserted into the clamping mechanism of the upper frame construction;

FIG. 7 is a sectional view taken along lines 7—7 of FIG. 4; and

FIGS. 8 and 9 respectively show sectional views taken along lines 8—8 and 9—9 of FIG. 2.

In the various figures of the drawing, like reference characters designate like parts.

DETAILED DESCRIPTION OF THE PREFERRED EMBODIMENT

Figure 1:
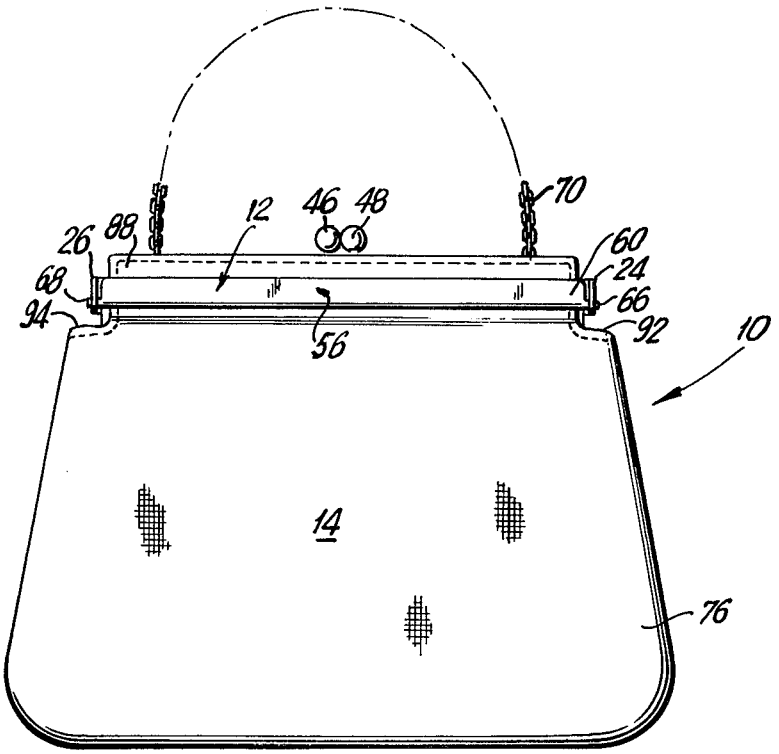
FIG. 1 is an elevational view showing the assembled pocketbook, in accordance with the present invention.
Figure 2:
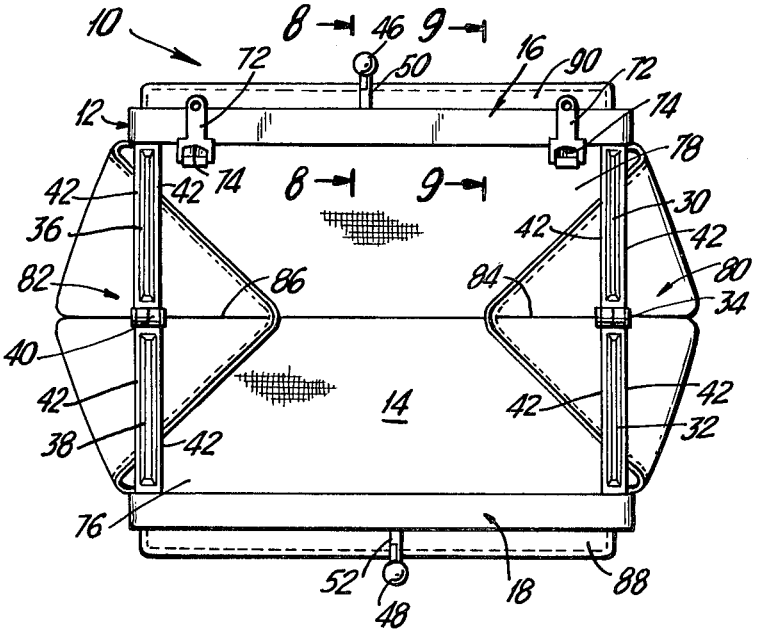
FIG. 2 is a top plan view showing the pocketbook of the present invention, the pocketbook being in an open condition.

Referring now to FIGS. 1–3, the pocketbook of the present invention is shown generally at 10 and comprises a frame 12 to provide an upper frame construction which supports a bag or pouch 14. The frame 12 includes two substantially parallel support bars 16, 18 which are formed as thin, flat, metal members terminating at each lateral end with outwardly directed end flaps or ears 20, 22 and 24, 26, respectively. Each end flat has an aperture 28 formed therethrough.

The support bars 16, 18 are interconnected at one end by a pair of folding arms 30, 32 which are in turn interconnected by a hinge 34. At the other end, the support bars are interconnected by the folding arms 36, 38 and the interconnecting hinge 40 therebetween. Each of the folding arms includes stiffening webs 42 for support thereof.

The folding arms are connected to the support bars by permanently attaching, by conventional means, the distal ends of each of the folding arms onto the outer surface of the support bars, as shown at 44 in FIG. 3.

In order to close the pocketbook, a conventional clasp is provided comprising the mating, snap together parts 46, 48. The two clasp parts are snapped together, as shown in FIG. 1, in order to maintain the pocketbook closed and, when desired, can be spread apart to open the pocketbook, as shown in FIG. 2, in accordance with conventional practice.

Each of the clasp parts 46, 48 includes a spherical head mounted on the end of rod body portions 50, 52, respectively, which are permanently attached to the support bars 16, 18 by conventional means onto the outer surface thereof, as shown at 54 in FIG. 3.

A clamping bar 56 is pivotally connected with respect to the support bar 18, and a corresponding clamping bar 58 is pivotally connected with respect to the other support bar 16. Each of the clamping bars 56, 58 is formed of a substantially L-shaped lateral cross section including a longer leg 60, a shorter leg 62, and an interconnecting vertex section 64. At the lateral ends of each of the clamping bars are integral pins 66, 68 which extend through the apertures 28 of the end flaps of the support bars 16, 18, thereby permitting pivoting of the clamping bars with respect to the support bars.

A chain 70 is connected to one of the support bars by means of the couplers 72 which are attached by the hinge members 74 to the inner surface of the support bar 16, the hinge members 74 being permanently secured to the support bar. The hinge members 74 are connected at the distal ends of the couplers 72 by means of a conventional yoke arrangement, so that the couplers 72 can pivot. Thus, when the chain 70 is not desired for use, the chain 70 is placed inside the bag 14, whereby the couplers 72 are pivoted downward away from the support bar 16 to facilitate the storage position of the chain 70.

The bag or pouch 14 includes side walls 76, 78 interconnected at their lateral ends by gussetted end walls 80, 82 which bend inwardly along the fold lines 84, 86. The folding arms 30, 32 on either side of the upper frame construction are so positioned as to lie laterally outward of the end walls 80, 82, as best shown in FIG. 2, so as to assist in pushing inwardly the end walls along the fold lines 84, 86, to facilitate closure of the pocketbook, as shown in FIG. 1.

Upwardly extending from each of the side walls 76, 78 are extensions 88, 90. The side walls 76, 78 extend laterally outward beyond the side edges of the upward extensions 88, 90 so as to define a pair of shoulders 92, 94 on either side of the extension 88 and corresponding pairs of shoulders 96, 98 on either side of the extension 90. These shoulders form a stop for insertion of the extensions into the clamping mechanism, as will hereinafter be described.

As can best be seen in FIG. 3, the side walls of the pouch are formed of an outer layer of material 100 separated from an inner layer 102 by means of a liner or body material 104. This construction provides sufficient stiffness for the pocketbook side walls. The extensions however, generally do not require the stiffening material and are directly sandwiched together to form the double layer. A channel 106 is formed longitudinally across the extensions which receives a compressible cord 108 which is securely held by means of the lines of stitching 110, 112 on either side of the channel as can best be seen in FIG. 4.

The readily assemblable connection of the pouch to the upper frame construction will be described with respect to FIGS. 4–9, wherein the clamping arrangement on only one side of the pocketbook will be described, it being understood that the clamping arrangement on the other side of the pocketbook functions in the same manner. In FIG. 5 the upper extension 90 of the pouch is shown positioned beneath the upper frame construction. The extension 90 includes the two layers of material 100, 102 with the channel 106 therein for securely holding the cord 108. The upper frame construction includes the L-shaped clamping bar 58 with the longer leg 60 and the shorter leg 62 as well as the vertex section 64. It should be noted that the clamping bar is pivoted with respect to its support bar 16 at approximately its vertex where the pivot pin extends into the apertures 28 formed in the end flaps.

As shown in FIG. 5, with the clamp in its open position, a space or entry channel 114 is defined between the clamping bar and the support bar. The size of the entry channel 114 is such that it can proximately receive the insertion of the side wall extension.

As is best shown in FIG. 6, the side wall extension 90 is pushed through the entry channel 114 so as to position the cord 108 above the clamping bar 58, as best seen in FIGS. 4 and 7. It should be noted that the space of the entry channel 114 is slightly less than the thickness of the extension at the point of the cord, and accordingly, the cord will be slightly compressed as its enters and therefore a force will have to be exerted on the extension in order to push it through the entry channel.

Once through the entry channel 114, the clamping bar 58 is swung upwardly, as shown by the arrows 116 in FIG. 8, so as to position the cord 108 within the vertex 64 of the clamping bar 58. The cord 108 will then be securely held in place by the clamping bar, and the extension will not be able to be pulled out from the upper frame construction. The support bar 16 effectively serves as a backing member for the clamp mechanism. The space formed between the support bar 16 and the clamping bar 58 when the clamping bar is in a closed position, is less than the space formed when the clamping bar is in its open position. As a result, the material of the extension, as well as the cord, will both be squeezed and held tightly clamped in place between the clamping bar 58 and the support bar 16 when the clamp is closed.

As shown in FIG. 8, the clasp body portion 50 depending from the clasp spherical ball 46 forms an additional thickness in the channel area so as to reduce the channel space in the area of the body portion attachment at 54. A similar reduction in channel space will also occur where the folding arms are connected onto the support bar at the lateral edges thereof. However, even in the remainder of the area where there is no additional thickness to reduce the channel space, as shown in FIG. 9, there will still be a squeezing and clamping action onto the pouch extensions by means of closing the clamping bar 58 against the support bar 16.

Accordingly, the closing of the clamping bar against the support bar will squeeze and hold the extension of the side walls of the pouch entirely across the length of the clamping bar. However, additional squeezing will take place in the areas in which there is an additional thickness where the clasp and folding arms are connected to the support bar. As a result of the present arrangement, the tolerances at which the various members are formed are not that critical. For example, even if the material of the pocketbook is not of uniform thickness, there will still be sufficient clamping action across the entire length of the clamping bar. This also facilitates the use of different types of materials which may vary in thickness.

Furthermore, the present invention eliminates the requirement of the prior art equipment usually used to permanently clamp the frame onto the pouch, and therefore reduces the time and labor costs for such permanent clamping.

In order to remove the pouch, the clamp is swung open, reversing the direction of the arrow shown in FIG. 8. The extension and clamp will then be in a position as shown in FIG. 4. The extensions can then be pulled out from the channel formed between the clamping bar and the support bar. Other types of pouches can then be inserted into the hinged upper frame construction. In this manner different types of pouches can be attached to the same upper frame construction in order to match various wardrobes, changes in styles, or to replace the pouch when it becomes worn.

It should be understood that modifications may be made. For example, the cord held in the extension need not be a separate cord but can be a portion of the material folded over into a hem. Additionally, if a cord is used, it can be held in place by sealing methods, for example using adhesives or other such means. Similarly, instead of the integral hinges formed at the end of the upper frame construction, other hinge arrangements can be utilized.

Numerous alternatives of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A pocketbook comprising a hinged frame construction, a pouch supported therefrom, and clamping means disposed on said frame construction and cooperative with portions of said pouch for supporting and releasably retaining said pouch on said frame construction;

said frame construction including opposing support bars interconnected at their respective ends by folding arms, said clamping means including a clamping bar pivotally coupled with respect to each said support bar, each said support bar being spaced from its respective clamping bar, each clamping bar being rotatable between an open position to provide an entry channel between each said support bar and its respective clamping bar for receiving therein a respective one of said portions of said pouch, and a closed position wherein each respective pouch portion is retained clamped between an associated one of said support bars and its respective clamping bar;

transverse end plates provided at respective ends of each of said support bars, an aperture provided in each end plate, and pivot pins longitudinally extending from respective opposite ends of each clamping bar and being received in a respective one of the apertures in said end plates so that a pivot arrangement is provided between said support bars and said clamping bars;

said pouch including side walls, and said pouch portions including upwardly directed extensions from said side walls; said side walls being wider than said extensions so as to laterally extend beyond said extensions to provide shoulder portions which serve as stops for the entry of said extensions into said channels;

a compressible cord longitudinally disposed across each of said extensions and being capable of entry into said channels in said open position of said clamping bars, and being incapable of exit in said closed position thereof;

each said compressible cord being sandwiched between two layers of pouch material secured together to define said extensions, each said cord being retained in a longitudinal channel provided between said two layers to provide a compressible rib across each of said extensions;

each said clamping bar being substantially L-shaped in transverse cross section, a vertex part of each said clamping bar providing a recess for said compressible rib when each said clamping bar is in said closed position to thereby retain each said compressible rib and extension when in said closed position;

each said entry channel having a space less than thickness of each said compressible rib to require each said rib to be compressed as each said rib passes through said entry channel in order to prevent each said rib from passing back out of said entry channel without exerting a force thereon; and each said recess having a space less than said thickness of each said compressible rib so that legs of each of said L-shaped clamping bars squeeze and hold each said rib tightly clamped in place between its associated clamping bar and support bar when in said closed position.

2. A pocketbook as in claim 1, wherein said folding arms have their distal ends secured onto surfaces of said support bars so as to face its respective clamping bar to thereby provide a reduced channel space in an area of securement.

3. A pocketbook as in claim 1, and further comprising opposing clamp members for closing the pocketbook, each clasp member having a depending connecting arm secured onto a surface of each support bar so as to face its respective clamping bar to thereby provide a reduced channel space in an area of securement.

4. A pocketbook as in claim 1, wherein said pouch includes side walls and interconnecting gussetted end walls, and wherein said folding arms are located laterally outward of said end walls.

* * * * *